United States Patent [19]

Conrad et al.

[11] 4,212,632

[45] Jul. 15, 1980

[54] COOLING ARRANGEMENT FOR ROTARY KILN

[75] Inventors: Ralph M. Conrad; Robert M. Bliemeister, both of Milwaukee, Wis.

[73] Assignee: Allis-Chalmers Corporation, Milwaukee, Wis.

[21] Appl. No.: 35,406

[22] Filed: May 2, 1979

[51] Int. Cl.[2] ..... F27B 7/24

[52] U.S. Cl. ..... 432/115; 34/242

[58] Field of Search ..... 432/103, 105, 115, 116, 432/117, 119; 34/242

[56] References Cited

U.S. PATENT DOCUMENTS

| | | | |
|---|---|---|---|
| 2,266,396 | 12/1941 | Lincoln et al. | 432/115 |
| 2,584,808 | 2/1952 | Newhouse | 432/13 |
| 2,826,403 | 3/1958 | Moklebust | 432/115 |
| 2,852,242 | 9/1958 | Simon | 432/115 |
| 3,016,236 | 1/1962 | Alonso | 432/116 |
| 3,042,389 | 7/1962 | Gieskieng | 432/115 |
| 3,068,015 | 12/1962 | Roubal | 277/101 |
| 3,806,311 | 4/1974 | Barber | 432/115 |
| 3,940,239 | 2/1976 | Rossi et al. | 432/115 |

*Primary Examiner*—Henry C. Yuen

*Attorney, Agent, or Firm*—Robert C. Sullivan; Arthur M. Streich

[57] ABSTRACT

An arrangement for mounting a cooling cowl on the discharge end of a rotary kiln which allows for radial and axial differential expansion between kiln and cowl. The cowl is mounted on the kiln contiguous the kiln discharge end, with the cowl being positioned radially outwardly of the outer peripheral surface of the kiln to define an annulus between the inner peripheral surface of the cowl and the outer peripheral surface of the kiln through which cooling air can flow. A radially outer set of end castings is supported by the kiln at the discharge end and defines an axial end closure for the annulus. A radially inner set of end castings is supported by the kiln at the discharge end and retains the "nose brick" of the kiln lining. Both the radially outer and the radially inner end castings are supported by the kiln so as to be structurally independent of the cowl. A plurality of spacer bars made of a flexible material such as steel is positioned in the annulus, the bars extending in a direction substantially parallel to the axis of rotation of the kiln and being angularly spaced apart, the respective bars being fixedly secured at one end thereof only to the cowl and at the opposite end thereof only to the kiln. A pair of keeper blocks, preferably supported by the cowl, are positioned contiguous opposite circumferentially spaced sides of a given spacer bar whereby to substantially prevent circumferential shifting of the cowl.

11 Claims, 10 Drawing Figures

COOLING ARRANGEMENT FOR ROTARY KILN

TECHNICAL FIELD

This invention relates to rotary kilns and more particularly to an improved cooling arrangement for the discharge end of a rotary kiln.

DESCRIPTION OF THE PRIOR ART

It is well known in the prior art to mount a cowl or shroud on the discharge end of a rotary kiln, with cooling air being circulated through the cooling cowl for the purpose of cooling the kiln shell and for cooling the discharge end castings. The discharge end of the rotary kiln is subjected to extremely high temperatures and, unless suitable provision is made for cooling the kiln shell and the end castings at the discharge end of the kiln, the discharge end of the kiln shell and the discharge end castings would ultimately be destroyed by the high temperature conditions to which they are subjected.

The following U.S. Pat. Nos. are illustrative of the prior art use of cooling cowls on the discharge end of rotary kilns, as just described: 2,852,242—Simon; 2,826,403—Moklebust; 3,016,236—Alonso; 3,042,389—Gieskieng; 3,940,239—Rossi et al; 3,068,015—Roubal; and 2,584,808—Newhouse.

In the prior art cooling arrangements utilizing a cooling cowl positioned about the discharge end of a rotary kiln, it is the usual practice to position spacer bars between the outer periphery of the kiln and the inner diameter of the cooling cowl, these spacer bars extending in a direction parallel to the axis of rotation of the kiln and normally being welded at each end of each respective spacer bar to both the kiln and to the cooling cowl.

Various problems have been encountered in connection with the mounting arrangement of prior art cooling cowls on the discharge end of rotary kilns. During operation of the rotary kiln, the kiln shell reaches a higher temperature than the cowl resulting in thermal stresses in the kiln shell, cowl, spacer bars and the welds as well as distortion of the cowl and the spacer bars. In the prior art mounting arrangement for the cooling cowl, the welds between the spacer bars and the cowl and/or between the spacer bars and the kiln shell may crack from the excessive thermal stresses. After failure of the welds, the cowl can shift position on the kiln shell resulting in loosening of or loss of the brick retaining castings which retain the "nose brick" at the discharge end of the kiln, with resulting high maintenance costs.

A further problem sometimes encountered in the prior art cooling cowl mounting arrangements is that upon the thermal expansion of the kiln shell during operation the spacer bars between the cooling cowl and the kiln shell would push radially outwardly against the inner diameter of the cooling cowl and "emboss" the cowl in the region of the respective spacer bars to cause a "scallop" effect on the outer peripheral surface of the cooling cowl. This "scallop" effect, in turn, reduces the sealing efficiency and life of the air seals, such as that shown in U.S. Pat. No. 3,042,389—Gieskieng, for example, which seals against the outside surface of the rotating cowl.

STATEMENT OF THE INVENTION

Accordingly, it is an object of the present invention to provide an improved air cooled discharge end arrangement for use on a rotary kiln, which allows for radial and axial differential expansion between the kiln shell and the cooling cowl whereby to prevent distortion of the cooling cowl and of the spacer bars between the cowl and the kiln shell at the discharge end of the kiln.

It is a further object of the invention to provide a unique mounting arrangement for a cooling cowl at the discharge end of a rotary kiln which allows for radial and axial differential expansion between the kiln shell and the cooling cowl without distortion of the kiln shell, cowl, or spacer bars, and without damage to the welds and to the brick retaining castings and associated castings.

It is a further object of the invention to provide an improved mounting arrangement for the cooling cowl at the discharge end of a rotary kiln which provides increased service life and reduced maintenance costs for the cooling cowl and for the contiguous discharge end castings and of the "nose brick" at the discharge end of the kiln by eliminating weld cracking and permanent deformation of the kiln shell, cowl and cowl spacer bars.

It is a further object of the invention to provide an improved mounting arrangement for the cooling cowl at the discharge end of an air cooled rotary kiln in which the cooling cowl is maintained in substantially constant concentricity with the outer periphery of the rotary kiln and without distortion or "scalloping" of the contour of the cowl, whereby to improve the efficiency and life of air seals which seal against the outer periphery of the rotating cowl.

It is a further object of the invention to provide an improved mounting arrangement for a cooling cowl mounted at the discharge end of a rotary kiln, in which the cooling cowl and the end castings, at the discharge end of the kiln, are independent from each other whereby radial movement of the cooling cowl and of the kiln shell relative to each other due to differential expansion characteristics does not affect the discharge end castings or the hardware associated with the dischage end castings.

In achievement of these objectives, there is provided in accordance with the invention in combination, a rotary kiln, a cooling cowl mounted on said kiln contiguous the discharge end of the kiln, said cowl being positioned radially outwardly of the outer peripheral surface of the kiln whereby to define an annulus between the inner peripheral surface of said cowl and the outer peripheral surface of said kiln through which cooling air can flow to cool the discharge end of said kiln, means supported by said kiln contiguous the discharge end of said kiln for forming an axial end closure for said cowl annulus, a plurality of spacer bars made of a flexible material are positioned in the annulus between said cowl and said kiln, said spacer bars extending in a direction substantially parallel to the axis of rotation of said kiln and being angularly spaced apart from each other, the respective spacer bars being fixedly secured at one end thereof only to said cowl and at the opposite end thereof only to said kiln.

Further objects and advantages of the invention will become apparent from the following description taken in conjunction with the accompanying drawings in which:

BRIEF DESCRIPTION OF THE DRAWINGS

FIG. 6 illustrates the cold condition of the kiln and cowl while FIG. 7 illustrates the hot conditions of the kiln and cowl;

DESCRIPTION OF THE PREFERRED EMBODIMENT

Figure 1:
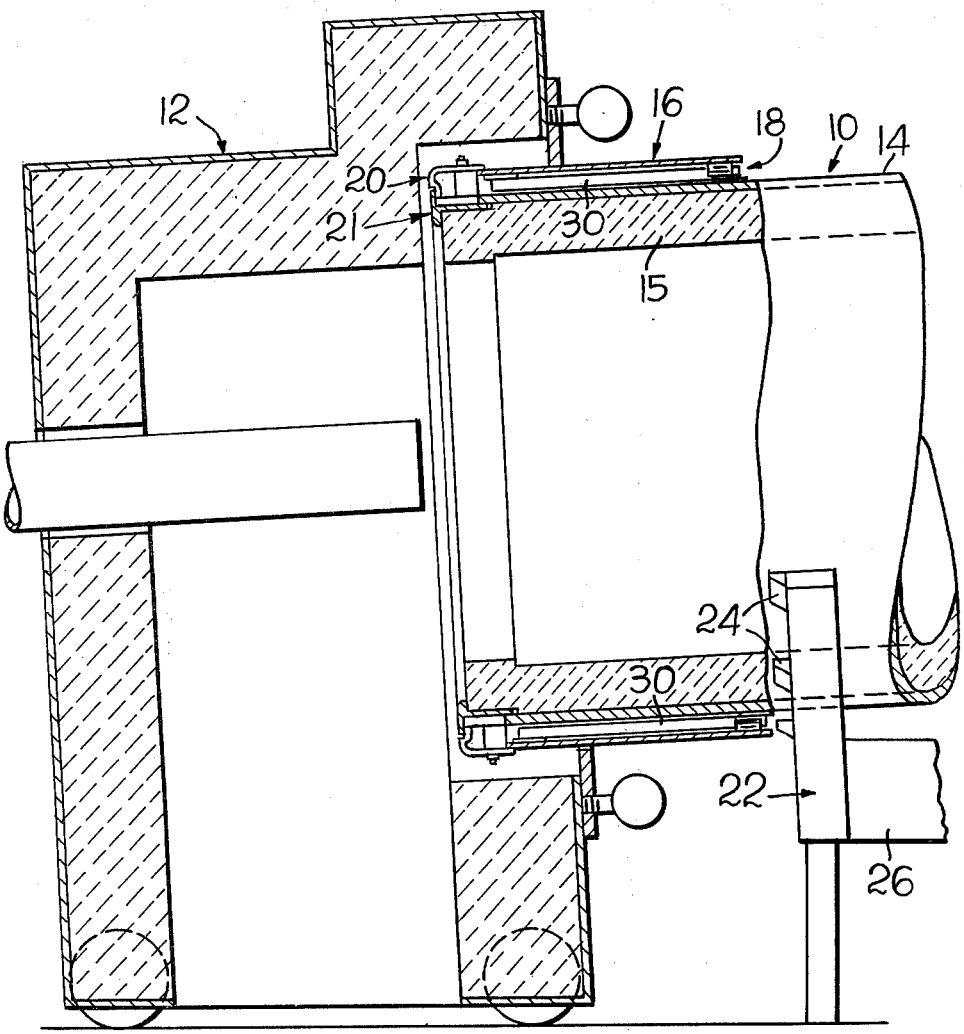
FIG. 1 is a view longitudinal section of the discharge end of the rotary kiln showing the cooling cowl and associated mounting arrangement of the present invention on the discharge end of a rotary kiln.
Figure 2:
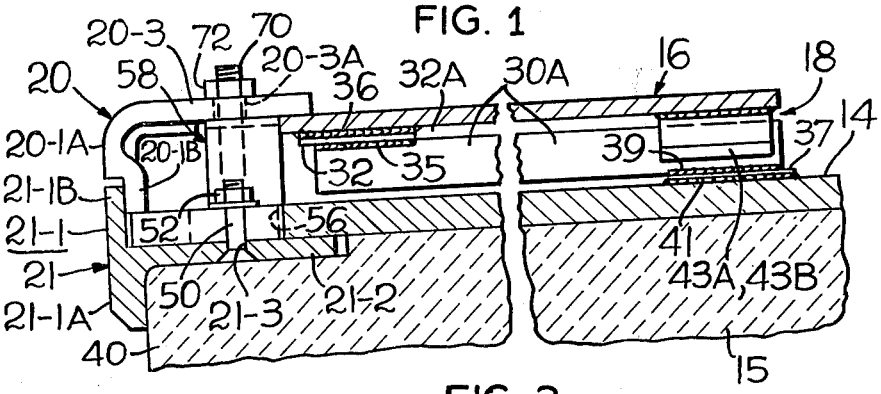
FIG. 2 is a view taken in section along line II—II of FIG. 3.

Referring now to the drawings and more particularly to FIG. 1, where is shown the discharge end of a rotary kiln generally indicated at 10 which inclines slightly downwardly from a feed end housing (not shown) to a stationary firing hood 12 to assist in the movement of material through the kiln from the feed end to the firing hood 12. Kiln 10 comprises a tubular or cylindrical steel shell 14 having an internal lining 15 formed of a suitable material, such as, for example, refractory bricks. Kiln 10 is supported for rotation and is rotatably driven in a manner well known in the art as shown and described, for example, by U.S. Pat. No. 3,042,389 issued to David H. Gieskieng on July 3, 1962 and by U.S. Pat. No. 3,511,093, issued to Eugene B. Cook on May 12, 1970. A suitable seal 17, such as one of those shown in the aforementioned U.S. Pat. No. 3,042,389 of David H. Gieskieng, may be used to seal the substantially annular clearance space 19 between rotary kiln 10 and firing hood 12. A cooling cowl or shroud generally indicated at 16 and formed of steel or the like is supported concentrically about the outer periphery of the discharge end of kiln 10, the inner diameter of cowl 16 being spaced from the outer periphery of kiln 10 to define an annulus 18 between the cowl and the kiln. The axially outermost end of cooling cowl 16 at the discharge end of the kiln is closed by a circumferentially extending radially outer set of discharge end castings formed of cast iron or steel and generally indicated at 20, as best seen in FIG. 2. Radially outer discharge end castings 20 are structurally interrelated with and cooperate with a radially inner set of iron or steel castings 21 which retain the nose brick 40 at the discharge end of kiln 10.

Cooling air is supplied to cowl 16 by a stationary fluid manifold generally indicated at 22 which underlies a portion of the outer periphery of kiln shell 14 such as for a peripheral angle of 120°–180°, for example. Manifold 22 is provided with a plurality of angularly spaced nozzles 24 which direct cooling air into the inlet end of cowl 16, whereby the cooling fluid passes into the annular space or annulus 18 between cowl 16 and the outer periphery of kiln shell 14. The cooling air introduced into annulus 18 of cowl 16 cools the discharge end of the kiln shell and also cools the radially outer and radially inner discharge end castings 20 and 21, respectively, at the discharge end of the kiln. A fan or blower (not shown) is connected by a duct 26 in fluid communication with manifold 22 to supply cooling fluid to manifold 22.

In order to secure cowl 16 to and in substantially concentric relation with the outer periphery of kiln shell 14, a plurality of flexible spacer bars 30 are positioned in the space between the outer periphery of kiln shell and the inner diameter of cowl 16. Spacer bars 30 are formed of a suitable steel such as a mild or low carbon steel and have a spring-like characteristic which permits the spacer bars to move to accommodate radial and axial differential expansion characteristics of the kiln shell and cooling cowl during operation of the kiln. Spacer bars 30 extend in a direction parallel to the axis of rotation of rotary kiln 10, with the spacer bars being angularly spaced from each other by equal angular distances. The number of spacer bars 30 and the angular spacing between adjacent spacer bars may vary depending upon the diameter of the kiln. All of the spacer bars 30 are the same, and the manner of their connection to the cowl and to the kiln is the same so that a description of one spacer bar indicated at 30A and the manner of its connection to the cowl and to the kiln is equally applicable to all of the spacer bars 30.

As best seen in the views of FIGS. 2, 4, 6 and 7, the end of spacer bar 30A which is closest to the discharge end of the kiln is welded by a weld 35 to a permanent spacer pad 32 which in turn is welded by a weld 36 to the inner periphery of cooling cowl 16 contiguous the end of cooling cowl 16 closest to the discharge end of the rotary kiln. The opposite end of spacer bar 30A, i.e., the end of spacer bar 30A which is remotely located with respect to the discharge end of rotary kiln 10, is welded by a weld 39 to a second spacer pad 37 which, in turn, is welded by a weld 41 to the outer peripheral surface of kiln shell 14.

In order to simplify the description, the end of the spacer bar 30 or of the cowl 16 which is closest to the discharge end of the kiln may be referred to hereinafter in the specification and claims as the "near" end of the spacer bar of of the cowl; while the end of the spacer bar or of the cowl which is furthest away from or remote from the discharge end of the kiln may be referred to hereinafter as the "remote" end of the spacer bar or of the cowl.

Figures 3, 4, 5:
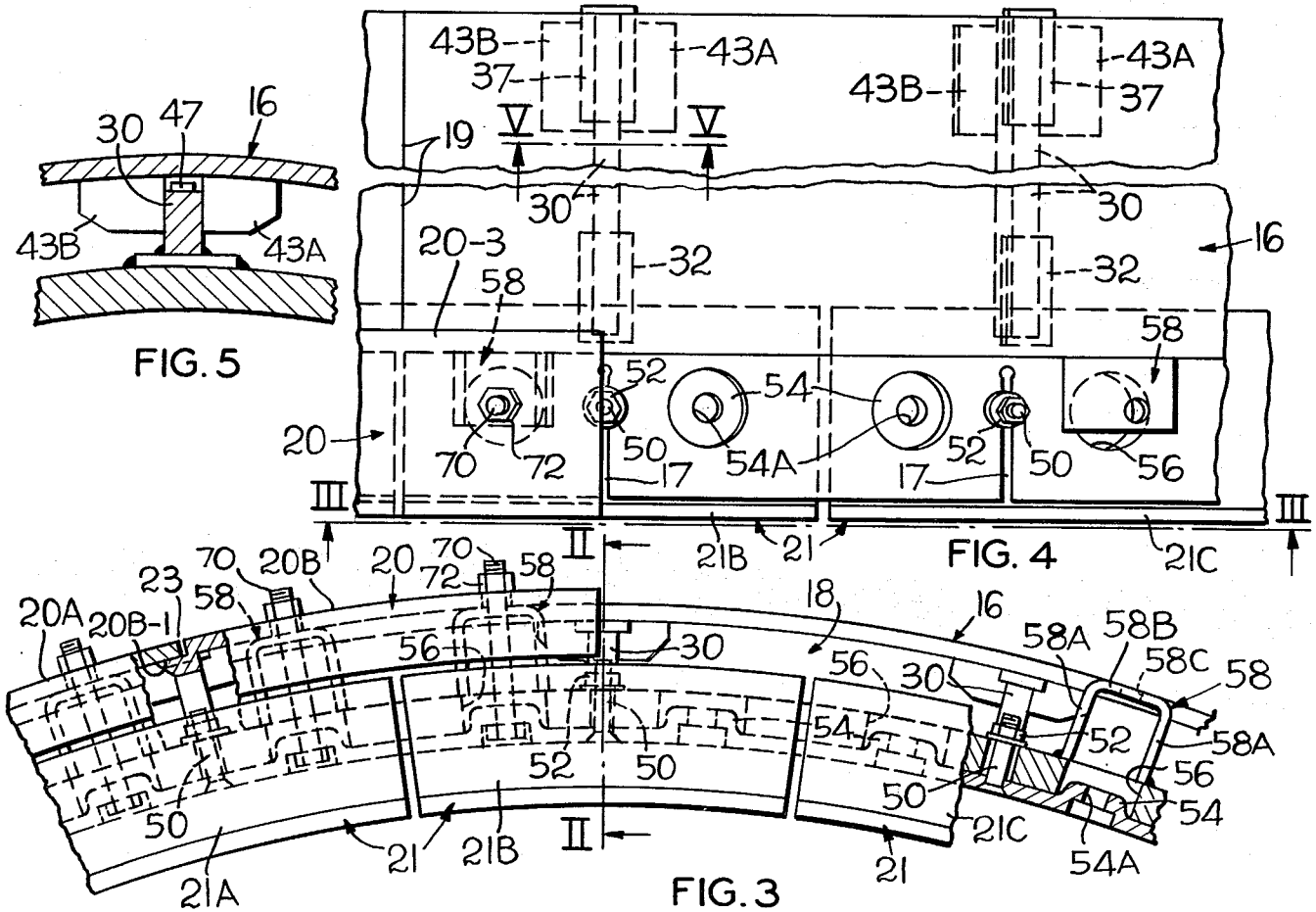
FIG. 3 is a fragmentary axial end view partially in section of the discharge end of the rotary kiln taken along line III—III of FIG. 4.
FIG. 4 is a fragmentary top plan view of FIG. 3.
FIG. 5 is a view taken along section line V—V of FIG. 4.

A further feature of the construction is the provision of a pair of keeper blocks, respectively indicated at 43A and 43B and best seen in the view of FIG. 5, which in the embodiment of FIGS. 1–7, inclusive, are secured as by welding, to the inner peripheral surface of cowl 16 at the end of the cowl which is remote from the discharge end of the kiln, with the respective keeper blocks 43A and 43B lying on opposite sides of and in close proximity to the respective opposite circumferentially spaced sides of spacer member 30A. In the embodiment of FIGS. 1–7, inclusive, a pair of keeper blocks, such as 43A, 43B are provided for each respective spacer bar 30 contiguous the end of the spacer bar which is remote from the discharge end of the kiln. The keeper blocks 43A, 43B serve the following functions: (1) they prevent circumferential shifting of cowl 16 relative to kiln shell 14; (2) keeper blocks 43A, 43B tend to maintain a relatively constant annular clearance between the outer peripheral surface of kiln 10 and the inner diameter of cooling cowl 16, whereby to maintain substantially constant the relative concentricity between cowl 16 and kiln shell 14.

In the embodiment of the invention illustrated in FIGS. 1–7, inclusive, spacer bars 30 have been shown connected as by welding to the cowl at the end of the respective spacer bars closest to the discharge end of the kiln, while the end of the respective spacer bars 30 remote from the discharge end of the kiln have been shown as being welded to the outer peripheral surface of the kiln. This arrangement is the preferred embodiment since, as hereinbefore described, it permits the cowl assembly to be manufactured as a complete subassembly which may then be installed on the kiln merely by completing the field weld 41 between the shop-installed permanent spacer pad 37 at the "remote" end of spacer bar 30 and the outer peripheral surface of kiln shell 14.

Figure 9:
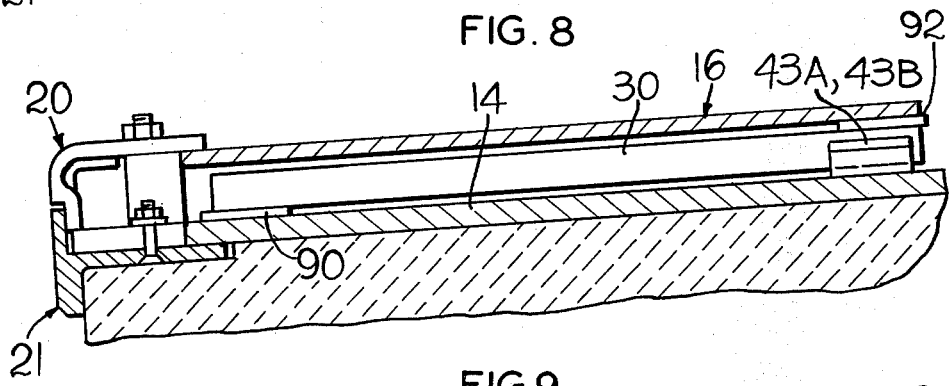
FIG. 9 is a view in longitudinal section of the discharge end of the kiln in which the connections of the spacer bar to the cowl and kiln are reversed as compared to the embodiments of FIGS. 1–7, inclusive and of FIG. 8; and, with the position of the "keeper" blocks also being different than in FIGS. 1–7, inclusive.
Figure 10:
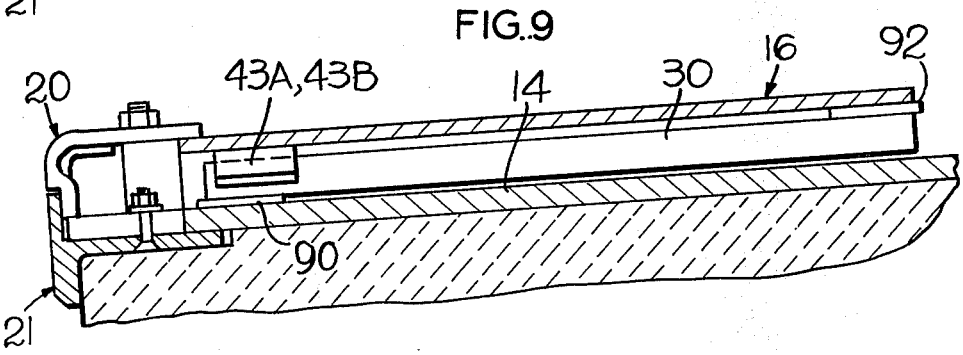
FIG. 10 is a view taken in longitudinal section of the discharge end of the kiln in which the connections of the spacer bar to the cowl and kiln are similar to the embodiment of FIG. 9, but in which the position of the "Keeper" blocks is different than in the embodiment of FIG. 9.

The arrangement just described is preferred from a manufacturing and assembly viewpoint since field weld 41 which results in the attachment of the "remote" end of spacer bar 30 to the outer peripheral surface of the kiln is a convenient location for such a field weld. However, it is also within the scope of the present invention to reverse the previously described welded connections of spacer bar 30 to cowl 16 and kiln shell 14. That is, as shown in FIGS. 9 and 10, spacer bar 30 and an associated permanent spacer pad such as spacer pad 90 could be attached to the kiln at the "near" end of spacer bar 30 (that is the end of spacer bar 30 closest to the discharge end of the kiln) while the "remote" end of spacer bar 30 and its associated permanent spacer pad 92 could be welded to the "remote" end of the cowl. Also, the circumferentially spaced keeper blocks 43A, 43B (FIGS. 2, 5) which are shown attached to cowl 16 and in straddling relation to the "remote" end of each spacer bar 30 in the embodiment of FIGS. 1–7, inclusive, could instead be positioned contiguous the "near" end of each respective spacer bar, as shown in FIGS. 8 and 10.

It will be noted that the radially inner surface of the spacer bar is always rigidly connected at one of the opposite ends thereof to the kiln, and that the radially outer surface of the spacer bar is always rigidly connected at one of the opposite ends thereof to the cowl. Hence, the radially outer surface of the spacer bar is always "free" (i.e.-unattached) at one end thereof and, similarly, the radially inner surface of the spacer bar is always "free" at one end thereof. The two keeper blocks 43A, 43B may be in straddling relation to either of the radially inner or to the radially outer "free" end of the spacer bar 30 and at either the "remote" end of the spacer bar or at the "near" end of the spacer bar.

Figure 6:
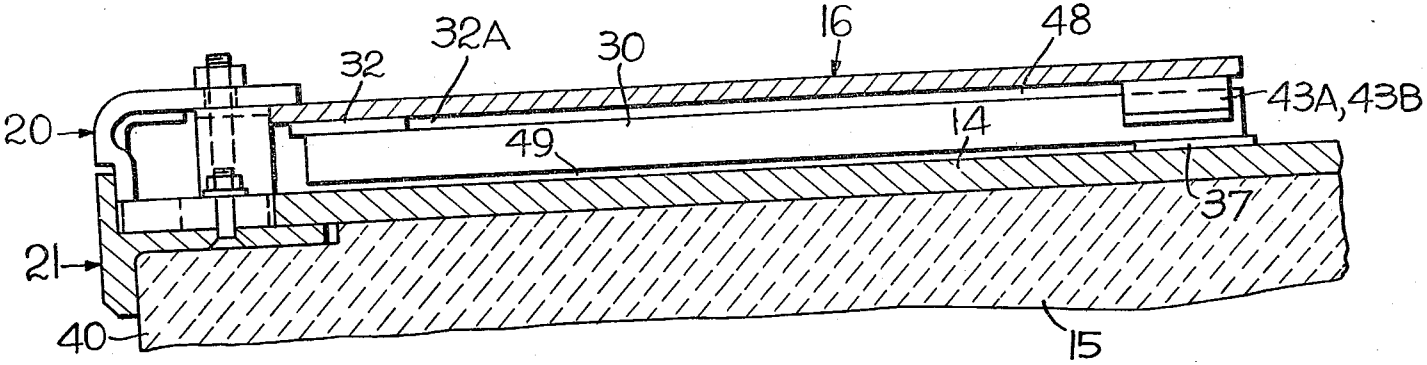
FIGS. 6 and 7 are views in longitudinal section of the discharge end of the kiln which illustrate the relative changes of the kiln and cowl which occur in changing from a cold to a hot condition of the kiln and cowl.
Figure 7:
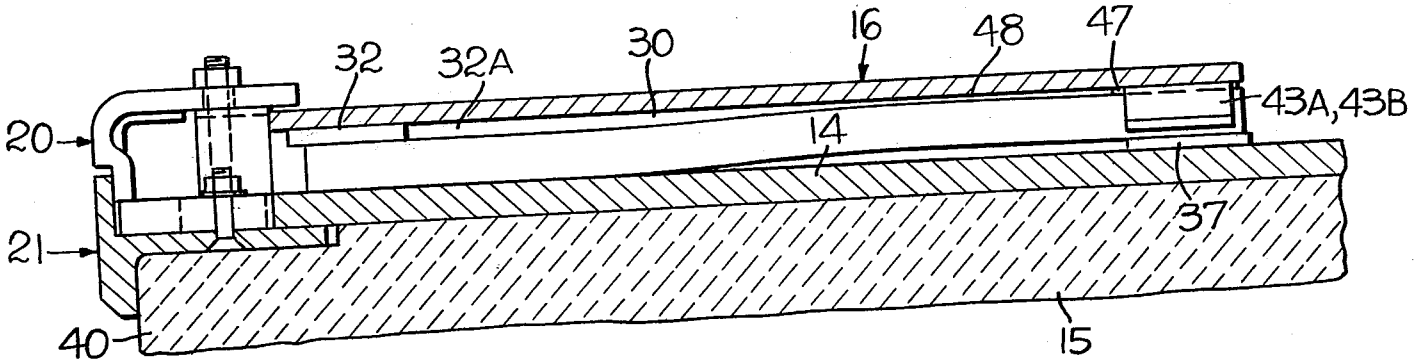
Figure 8:
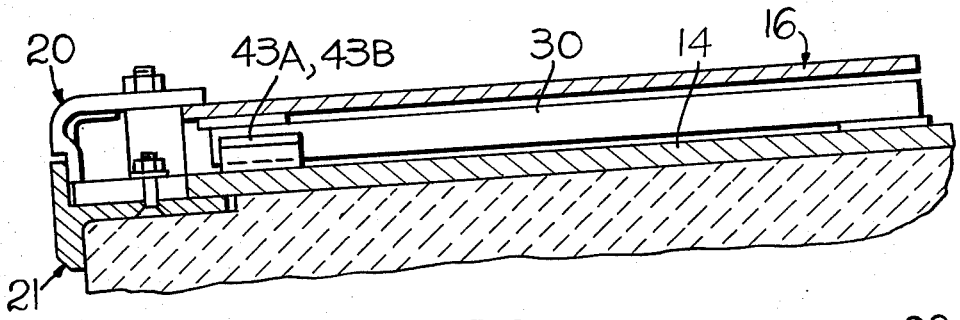
FIG. 8 is a view in longitudinal section of the discharge end of the kiln in which the spacer bar is connected to the cowl and kiln in the same manner as in the embodiment of FIGS. 1–7, inclusive, but in which the "keeper blocks" are located in a different position.

The embodiment shown in FIG. 8 is similar to the embodiment of FIGS. 1–7, inclusive, with respect to the connection of the spacer bar to the kiln and to the cowl. However, in the embodiment of FIG. 8 the keeper blocks 43A, 43B straddle the "free" end of spacer bar 30 at the "near" end of the spacer bar, with keeper blocks 43A, 43B being secured to the outer peripheral surface of kiln shell 14.

In the embodiment of FIG. 9, the keeper blocks 43A, 43B are also secured to the outer peripheral surface of kiln shell 14 and straddle the "free" end of spacer bar 30 at the "remote" end of spacer bar 30.

The embodiment of FIG. 10 is similar to that of FIG. 9 with respect to the connection of spacer bar 30 to the cowl and to the kiln. However, in the embodiment of FIG. 10, keeper blocks 43A, 43B are secured to the inner periphery of cowl 16 and straddle the "near" end of spacer bar 30.

Description of Discharge End Castings

As previously mentioned, the casting arrangement at the discharge end of the kiln comprises a radially inner set of castings generally indicated at 20 which serve to form a circumferentially extending axial end closure for the annulus 18 defined between the radially outer periphery of kiln shell 14 and the radially inner periphery of cooling cowl 16. The presence of the castings 20 which extend through a 360° arc to form an end closure for annulus 18, serves to prevent the cooling air which is admitted to the interior of annulus 18 from passing downwardly into firing hood 12 where such air would undesirably cool and contaminate the process air entering the discharge end of kiln 10 from firing hood 12.

The radially inner set of circumferentially extending castings 21 define a brick retaining ring which serves the function of engaging and retaining the nose bricks 40 at the discharge end of the rotary kiln, as is well known in the art.

An important feature of the construction is the fact that the discharge end castings, just described, and particularly the radially outer castings 20, are not supported in any manner by cowl 16 but rather are structurally independent of cowl 16. This is an important feature in combination with the spacer bar mounting arrangement hereinbefore described, since the mounting arrangement of the discharge end castings 20 and 21 permits relative radial and axial movement between cowl 16 and kiln shell 14 caused by differential expansion characteristics of the cowl and kiln shell, without such relative radial and axial movement of the cowl relative to the kiln shell adversely affecting the discharge end castings or the casting hardware, such as bolts and the like which secure the discharge end castings in position.

As best seen in the views of FIGS. 3 and 4, the radially inwardly lying brick retaining castings 21 define an annular brick retaining ring and comprise a plurality of similar casting sections or retaining ring segments, some of which indicated at 21A, 21B and 21C are shown in the views of FIGS. 3 and 4, and which together extend through a 360° arc to engage and retain nose bricks 40 at the discharge end of the kiln. Each of the brick-retaining ring segments or castings 21A, etc. includes a radially extending portion 21-1, including a radially inner portion 21-1A which engages and retains the axially outer end of nose bricks 40, and a radially outer portion 21-1B, which overlaps the axially outer end of kiln shell 14 and also overlaps the radially inner portion 20-1B of a corresponding radially outer casting 20 of the group of castings which serve as an end closure for annulus 18 between cowl 16 and the outer peripheral surface of kiln shell 14. Each brick retaining casting 21 also includes an arcuately and axially extending flange portion 21-2, which is received between the radially inner surface of kiln shell 14 and the radially outer surface of nose bricks 40.

Each of the brick-retaining castings 21 is provided with a passage 21-3 through the axial fange portion 21-2 thereof. Passage 21-3 terminates at the radially inner end thereof in a countersunk opening which receives a countersunk head bolt member 50, which extends through passage 21-3 and thence extends through an aligned passage in kiln shell 14. A nut member 52 threadedly engages the radially outer end of each bolt 50 whereby to secure the respective brick retaining casting 21 to kiln shell 14.

As best seen in the view of FIG. 3, each brick-retaining casting 21 is also provided in the axially extending flange portion 21-2 thereof and in oppositely disposed equally angularly spaced relation to the location of passage 21-3 for bolt 50 with a pair of oppositely disposed boss members 54 which are received in and project radially outwardly into a portion of the radial length of a corresponding passage of circular aperture 56 in kiln shell 14. Each of the boss members 54 in the axially extending flange portion 21-2 of brick-retaining casting 21 is provided with a passage 54A therein for receiving a fastening means to be described hereinafter. A support member generally indicated at 58 of generally U-shape is rigidly mounted as by welding in straddling relation to each circular aperture 56. Each U-shape member 58 includes a pair of circumferentially spaced legs each indicated at 58A and a circumferentially extending cross-piece portion 58B which connects the radially outer ends of the two legs 58A. Cross-piece portion 58B has a centrally located passage 58C therethrough, through which a fastening means extends in the final assembled position of the various parts as will be described.

The discharge end casting assembly also includes a plurality of radially outer castings generally indicated at 20 and specifically indicated at 20A, 20B, etc. In a rotary kiln of a given size, the number of outer discharge end castings 20 is the same as the number of radially inner brick-retaining castings 21. All of the radially outer discharge end castings 20A, 20B, etc., are substantially identical except for the fact that alternate castings, such as the casting 20B, are provided with a lip portion indicated at 20B-1 (FIG. 3) at each of the opposite circumferential ends of the given radially outer discharge end castings 20B, whereas the contiguous radially outer discharge end casting 20A does not have any such lip portions. The purpose of the lip portions 20B-1 at the opposite ends of each alternate radially outer discharge end casting 20 is to bridge the gap indicated at 23 (FIG. 3) between circumferentially adjacent outer discharge end castings such as 20A, 20B.

It will be noted that each of the radially outer discharge end castings 20 includes an axially outer wall portion 20-1A which lies substantially in the same radially and circumferentially extending plane as wall portion 21-1B of the corresponding radially inner brick retaining casting 21. Each radially outer discharge end casting 20 also includes a radially and circumferentially extending radially inner wall portion 20-1B which is recessed axially inwardly relative to the radially outer wall portion 20-1A of the given casting 20 whereby the radially inner wall portion 20-1B is nested with respect to the corresponding brick-retaining casting 21 so as to lie axially inwardly of but contiguous the corresponding brick retaining casting 21.

Each of the outer discharge end castings 20 also includes a cover or radially outer portion 20-3 which extends circumferentially and also in a generally axial direction. When the radially outer discharge end castings 20, the radially inner brick-retaining castings 21 and the kiln shell 14, are all assembled with respect to each other as shown in the drawings, a bolt 70 extends through the passage 54A in boss 54 of each brick-retaining casting 21, through the circular opening 56 in kiln shell 14 and through the passage 58C in cross portion 58B of outer casting support 58 and thence through a cooperating aligned passage 20-3A in the radially outer cover portion 20-3 of each respective outer discharge casting 20. A nut 72 engages the threaded radially outer end of bolt 70, whereby to secure the corresponding radially outer discharge end casting 20, the radially inner brick-retaining casting 21 and kiln shell 14 in assembled relation with respect to each other as shown in the views in the drawings.

The respective outer discharge end casting 20 are seated on and are supported by the two U-shaped casting support members 58 corresponding to each outer discharge end casting 20 such as 20A, 20B, etc., since the axially extending portion 20-3 of each respective outer discharge end casting 20 rests on the radially outer surface of two angularly or circumferentially spaced outer casting supports 58.

As best seen in the view of FIG. 4, the axially inner end of cover portion 20-3 of each radially outer discharge end casting 20 overlaps the axially outer end of cooling cowl 16. However, in the construction described hereinbefore and illustrated in the drawings, cooling cowl 16 does not support and is not supported by the radially outer discharge end castings 20.

It should be noted that cowl 16 and spacer bars 30 constitute a separate subassembly which may be assembled at the manufacturing plant and shipped in two 180° semi-cylindrical sections for installation at the site on the rotary kiln, which may be at a field location remote from the manufacturing plant. In accordance with the embodiment of FIGS. 1–7, inclusive, each cowl section has a plurality of angularly spaced spacer bars 30 welded to corresponding permanent spacer pads 32 and 37 which in turn are welded to the inner periphery of the respective cowl section contiguous the end of the cowl which is to be positioned closest to the discharge end of the kiln. The permanent spacer pad 32 provides a clearance space 32A (FIGS. 2, 6 and 7) which permits each respective spacer bar 30 to expand radially outwardly with the expanding kiln shell 14 toward the inner periphery of cowl 16 as the kiln shell expands at a faster rate than cowl 16 due to the higher temperature of the kiln shell. It should be noted that in the embodiment of FIGS. 1–7, inclusive, the permanent spacer pad 37 is welded at the factory to the radially inner surface of spacer bar 30 at the remote end of the spacer bar with respect to the discharge end of the kiln and is thus shipped from the factory as part of the cowl subassembly. Permanent spacer pad 37 is secured by welding to the outer periphery of the kiln by a field weld at the kiln site, thereby securing the "remote" end of spacer bar 30 to the kiln.

A permanent spacer or shim 47 (FIGS. 5 and 7) may be fixedly secured to the radially outer surface of spacer bar 30 contiguous the "remote" end of spacer bar 30 so that the "remote" end of spacer bar 30 in the fully expanded position of FIG. 7 will substantially engage the radially inner surface of cowl 16, which is desirable. If the cowl subassembly is built in accordance with the illustrated embodiment of FIGS. 1–7, inclusive, each of the semi-cylindrical cowl subassemblies also has secured thereto keeper blocks 43A and 43B which straddle the "free" end of the spacer bar 30, which free end is remote from the discharge end of the kiln when the cowl subassembly is installed. Also, if the cowl subassembly is built in accordance with the embodiment of FIG. 10, keeper blocks similar to keeper blocks 43A and 43B are secured to the cowl contiguous the end of th cowl closest to the discharge end of the kiln and straddle the opposite circumferentially-spaced sides of the corresponding free end of the spacer bar 30.

Description of Assembly Procedure for Cooling Cowl and for Discharge End Castings The following assembly steps are described with reference to the embodiment shown in FIGS. 1–7, inclusive.

1. The first step in the assembly procedure is to weld a U-shaped outer casting support 58 in straddling concentric relation to each opening 56 in kiln shell 14. Two outer casting supports 58 are provided in radially underlying supporting relation to cover portion 20-3 of each radially outer discharge end casting 20.

2. The cowl subassembly which is still in two semi-cylindrical sections is then positioned axially against the outercasting supports 58 which have now been welded in position, with the two halves of the cowl subassembly being circumferentially located so that the flexible spacer bars 30 lie along the center line of slots 17 (FIG. 4) in kiln shell 14, which are provided to relieve thermal stresses in the discharge end of the kiln shell.

3. Before welding the cowl halves together, a first temporary spacer block is installed at the end of each spacer bar 30 contiguous the discharge end of the kiln. The respective first temporary spacer blocks are interposed between the radially inner surface of each respective spacer bar 30 and the radially outer surface of the kiln shell at the discharge end. A shop installed second temporary spacer block had already been installed as by tack welding at the end of spacer bar 30 remote from the discharge end of the kiln between the radially outer surface of each respective spacer bar 30 and the radially inner surface of cowl 16. The temporary spacer blocks serve to center and stabilize the cowl subassembly while it is being mounted on the discharge end of the kiln.

4. The two halves of the cowl assembly are then welded together along weld line 19 (FIG. 4) and a field weld 41 is made between the permanent spacer pad 37 at the "remote" end of each spacer bar 30 and the outer periphery of kiln shell 14, thereby securing the "remotely located" end of spacer bar 30 to kiln shell 14. Spacer pad 37 had previously been shop welded to the radially inner surface of spacer bar 30. The temporary spacer blocks at the opposite ends of each spacer bar 30 are removed after completion of the welding of the cowl assembly to the kiln.

5. The radially inner or brick retaining castings 21 which define the brick retaining ring are then positioned in place as shown in the views in FIGS. 2, 3, and 4 with castings 21 being held in position by countersunk head bolts 50. The radially outer discharge end casting 20 are then placed into position as seen in the views of FIGS. 2, 3 and 4. Castings 20 and 21 are arranged so that the joints between contiguous outer discharge end castings 20A, 20B, etc. are offset from the joints between the inner brick retaining castings, such as 21A, 21B, etc. Outer discharge end castings 20, inner brick retaining castings 21, and kiln shell 14 are all secured in bolted assembled relation with respect to each other by bolts 70 which extend through passage 54A in axial flange portion 21-2 of brick retaining castings 21, through the circular opening or passage 56 in kiln shell 14, and through bolt passage 58C in the radially outer end of outer casting support 58, with bolt 70 then passaing through passage 20-3A in the axially extending cover portion 20-3 of the corresponding radially outer discharge end casting 20. Nut 72 engages the radially outer threaded end of each respective bolt 70 to secure castings 20, 21 and kiln shell 14 in assembled relation with respect to each other.

It will be noted that the axially extending cover portion 20-3 of each respective outer discharge end casting 20 is supported by and rests on the outer casting support 58 which in turn is fixed to kiln shell 14 and there is no connection between cowl 16 and the radially outer discharge end castings 20 which close the cowl annulus 18. Cowl 16 therefore does not support end discharge castings 20 which close the axial end of cowl annulus 18. Because of the construction just described and shown in the drawings, radial movement of cowl 16 relative to kiln shell 14 due to differential expansion between the cowl and the kiln does not affect radially outer discharge end castings 20 or brick-retaining castings 21 or the hardware associated with castings 20 and 21.

DESCRIPTION OF OPERATION

A comparison of FIG. 6 which shows the discharge end of the kiln when cold and FIG. 7 which shows the discharge end of the kiln when hot illustrates the changes which occur when the discharge end rises to operating temperature. Since kiln shell 14 becomes hotter than cowl 16, the outer periphery of kiln shell 14 expands radially outwardly toward the inner periphery of cowl 16, causing the "remote" end of spacer bar 30 which is anchored to kiln shell 14 through permanent spacer pad 37, to move with kiln shell 14 toward the inner periphery of cowl 16, causing spacer bar 30 to flex radially outwardly toward the radially inner periphery of cowl 16, as seen in FIG. 7. In the embodiment shown in FIGS. 6 and 7, the "near" end of spacer bar 30 closest to the discharge end of the kiln remains anchored to cowl 16 through permanent spacer pad 32.

In comparing the "hot" view of FIG. 7 with the "cold" view of FIG. 6, it will be noted that the hot kiln shell 14 in expanding radially outwardly toward cowl 16 has moved into and occupied clearance space 49 (FIG. 6) for a portion of the length of clearance space 49. Also, the "remote" end of the spacer bar 30 in moving radially outwardly toward cowl 16 as shown in FIG. 7 moves into the clearance space 48 (FIG. 6). Thus, it will be seen that permanent spacer pads 32 and 37 at the "near" end and at the "remote" end, respectively, of spacer bar 30 establish clearances 48 and 49, respectively, which help to accommodate the expansion of kiln shell 14 toward cowl 16 when the discharge end becomes heated during operation.

It is desirable that when spacer bar 30 has completed its maximum movement toward the inner periphery of cowl 16 during operation of the kiln that there be minimal clearance between the radially outer surface of spacer bar 30 and the radially inner surface of the cowl at the "remote" end of the cowl and spacer bar. Therefore, it may be desirable to attach a permanent shim 47 (FIGS. 5 and 7) to the radially outer surface of the "remote" end of spacer bar 30 to achieve the desired minimal clearance between spacer bar 30 and cowl 16 when spacer bar 30 is in its maximum expanded position.

From the foregoing detailed description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. In combination, a rotary kiln, a cooling cowl mounted on said kiln contiguous the discharge end of the kiln, said cowl being positioned radially outwardly of the outer peripheral surface of the kiln whereby to define an annulus between the inner peripheral surface of said cowl and the outer peripheral surface of said kiln through which cooling air can flow to cool the discharge end of said kiln, means supported by said kiln contiguous the discharge end of said kiln for forming an axial end closure for said annulus, a plurality of spacer bars made of a flexible material and positioned in the annulus between said cowl and said kiln, said spacer bars extending in a direction substantially parallel to the axis of rotation of said kiln and being angularly spaced apart from each other, the respective spacer bars being fixedly secured at one end thereof only to said cowl and at the opposite end thereof only to said kiln.

2. The combination defined in claim 1 in which said means for forming an axial end closure for said annulus is structurally independent of said cowl.

3. The combination defined in claim 1 in which the respective spacer bars are secured to said cowl at the end of the respective spacer bars closest to said discharge end of said kiln, with the opposite end of the respective spacer bars being secured to said kiln.

4. The combination defined in claim 1 in which the respective spacer bars are secured to said kiln at the end of the respective spacer bars closest to said discharge end of said kiln, with the opposite end of the respective spacer bars being secured to said cowl.

5. The combination defined in claim 1 in which a first spacer means is provided between said one end of said spacer bar and said cowl and a second spacer means is provided between said opposite end of said spacer bar and said kiln whereby to define a predetermined clearance space between said spacer bar and said cowl and between said spacer bar and said kiln to accommodate differential expansion of the kiln shell and said cowl, said first spacer means being secured to said cowl and to said one end of said spacer bar, and said second spacer means being secured to said kiln and to said opposite end of said spacer bar.

6. The combination defined in claim 1 which comprises keeper means lying contiguous opposite circumferentially spaced sides of a given spacer bar whereby to substantially prevent circumferential shifting of said cowl.

7. The combination defined in claim 1 in which said flexible material of which said spacer bars are made is steel.

8. In combination, a rotary kiln, a cooling cowl mounted on said kiln contiguous the discharge end of the kiln, said cowl being positioned radially outwardly of the outer peripheral surface of said kiln whereby to define an annulus between the inner peripheral surface of said cowl and the outer peripheral surface of said kiln through which cooling air can flow to cool the discharge end of said kiln, means supported by said kiln contiguous the discharge end of said kiln for forming an axial end closure for said annulus, a plurality of spacer bars made of a flexible material and positioned in the annulus between said cowl and said kiln, said spacer bars extending in a direction substantially parallel to the axis of rotation of said kiln and being angularly spaced apart from each other, the respective spacer bars being secured to said cowl at a first end of the respective spacer bars which is closest to said discharge end of said kiln, with the opposite end of the respective spacer bars being secured to said kiln, a first spacer means positioned between said first end of said spacer bar and said cowl and a second spacer means positioned between said opposite end of said spacer bar and said kiln whereby to define a predetermined clearance space between said spacer bar and said cowl and between said spacer bar and said kiln to accommodate differential expansion of the kiln shell and the cowl, said first spacer means being secured to said cowl and to said first end of said spacer bar, and said second spacer means being secured to said kiln and to said opposite end of said spacer bar.

9. The combination defined in claim 8 in which said means for forming an axial end closure for said annulus is structurally independent of said cowl.

10. The combination defined in claim 8 which comprises keeper means lying contiguous opposite circumferentially spaced sides of a given spacer bar whereby to substantially prevent circumferential shifting of said cowl.

11. The combination defined in claim 8 in which said flexible material of which said spacer bars are made is steel.

* * * * *